US005987292A

United States Patent [19]

Ohnishi

[11] Patent Number: 5,987,292

[45] Date of Patent: Nov. 16, 1999

[54] TRANSFER DEVICE HAVING A CONTROLLING SECTION FOR CONTROLLING CONTACT START CONDITIONS

[75] Inventor: Hideki Ohnishi, Chiba, Japan

[73] Assignee: Sharp Kabushiki Kaisha, Osaka, Japan

[21] Appl. No.: 09/120,144

[22] Filed: Jul. 22, 1998

[30] Foreign Application Priority Data

Aug. 11, 1997 [JP] Japan ..... 9-216156

[51] Int. Cl.[6] ..... G03G 15/16

[52] U.S. Cl. ..... 399/303; 399/66; 430/126

[58] Field of Search ..... 399/43, 66, 296, 399/297, 303, 313, 314; 430/126

[56] References Cited

U.S. PATENT DOCUMENTS

| | | | |
|---|---|---|---|
| 5,255,063 | 10/1993 | Ideyama et al. | 399/301 |
| 5,287,163 | 2/1994 | Miyashiro et al. | 399/66 |
| 5,390,012 | 2/1995 | Miyashiro et al. | 399/303 |
| 5,398,107 | 3/1995 | Bartholmae et al. | 399/296 |
| 5,592,273 | 1/1997 | Yamamoto | 399/297 X |
| 5,761,571 | 6/1998 | Suzuki et al. | 399/66 |
| 5,805,957 | 9/1998 | Kodama et al. | 399/66 |

FOREIGN PATENT DOCUMENTS

| | | |
|---|---|---|
| 6-035328 | 2/1994 | Japan . |
| 7-156446 | 3/1995 | Japan . |

*Primary Examiner*—William Royer
*Assistant Examiner*—Sophia S. Chen

[57] ABSTRACT

A transfer device which transfers a developer image formed on a surface of a photoreceptor drum to a transfer sheet is arranged so as to include a transfer drum for carrying the transfer sheet on a peripheral surface thereof, an electrode roller which can be moved to contact the transfer drum via the transfer sheet, and which can be moved apart from the transfer drum, and a control section for controlling contact start conditions between the transfer drum and the electrode roller. When the transfer sheet passes a spacing between the transfer drum and the electrode roller, the control section controls the contact start conditions in such a manner that a force is not exerted to a leading end portion of the transfer sheet from the electrode roller so as to separate the leading end portion from the transfer drum.

20 Claims, 8 Drawing Sheets

TRANSFER DEVICE HAVING A CONTROLLING SECTION FOR CONTROLLING CONTACT START CONDITIONS

FIELD OF THE INVENTION

The present invention relates to a transfer device for transferring a developer image on a surface of a photoreceptor to a transfer material such as a transfer sheet, etc., for use in an image forming apparatus adopting an electrophotographic printing method, such as a copying machine, a laser printer, etc., and more particularly relates to a transfer device provided with a transfer program for transferring a developer image onto the transfer material while being carried on a peripheral surface of a transfer drum.

BACKGROUND OF THE INVENTION

Known image forming apparatuses for forming an image by an electrophotographic printing method include those arranged so as to transfer a developer image formed on a surface of a photoreceptor to a transfer sheet (transfer material) being carried on a transfer drum. Such a transfer device adopting the transfer drum, for example, has an arrangement shown in FIG. 10. The transfer device includes a cylindrical transfer drum 101 having formed thereon a dielectric layer 101*a*, a charger 102 for making a transfer sheet P electrostatically adhere to a peripheral surface of the transfer drum 101; and a charger 104 for transferring a developer image onto the surface of a photoreceptor drum 103 to the transfer sheet P. The transfer drum 101 is oriented such that its rotation axis is positioned parallel to the rotation axis of the photoreceptor drum 103. The charger 102 and the charger 104 are provided on an inner circumference of the transfer drum 101 for transferring the developer image from the surface of the photoreceptor drum 103 to the transfer sheet P.

As shown in FIG. 11, another arrangement of the image forming apparatus has been proposed, which is provided with a transfer drum 201 of a double layer structure of a semiconducting dielectric layer 201*a* and an inner base 201*b*, and a grip mechanism 202 for holding the transported transfer sheet P on a peripheral surface of the transfer drum 201. In this image forming apparatus, in the state where the transfer sheet P is kept in contact with the peripheral surface of the transfer drum 201 via the zoo grip mechanism 202, the developer image is transferred to the transfer sheet P. In this state, the surface of the transfer drum 201 is charged either by applying the transfer voltage to the outer semiconducting dielectric layer 201*a* of the transfer drum 201 or by corona-discharging the inner surface of the transfer drum 201, thereby charging the surface of the transfer drum 201.

According to the described arrangement, the charger for making the transfer sheet P contact the peripheral surface of the transfer drum 201 can be omitted, and the number of chargers can be reduced.

In the arrangement of FIG. 11, however, although the charger for making the transfer sheet electrostatically adhere to the transfer drum can be omitted, a grip mechanism of a complicated structure is needed. Therefore, problems arise not only in that the grip mechanism of complicated structure is needed, but also in that the structure of the transfer device cannot be simplified, resulting in an increase in size of the transfer device.

In order to counteract the described problems, another transfer device has been proposed wherein a charge application means is provided for injecting charges by making contact with a transfer sheet which has not contacted a transfer material carrying member such as a transfer drum, etc., so that the transfer sheet is electrostatically attracted to the transfer material carrying member by the charges. As an example application of such transfer device, U.S. Pat. No. 5,390,012 discloses a transfer device including a transfer material carrying member composed of a dielectric layer and a foaming layer, and a space layer formed between these layers. The foaming layer is made of a foaming member formed on the electrically conductive drum substrate. The dielectric layer is provided so as to cover the foaming layer. The described transfer material carrying member is arranged so as to make the transfer material having charges injected thereon by the charge application means electrostatically attracted to the surface of the transfer material carrying member. According to the described arrangement, an electrostatic attraction of the transfer sheet onto the transfer material holding member can be improved.

However, in the conventional transfer device adopting the charge application means, a roller having a higher hardness than that of the transfer material carrying member composed of the foaming layer and the dielectric layer is used for the charge application means, and such roller of high hardness is made tight contact with the surface of the transfer material carrying member. Therefore, as shown in FIG. 12(*a*), when the roller 120 contacts the leading end of the transfer sheet P, a force is exerted onto the leading end portion of the transfer sheet P which has passed a spacing between the transfer material carrying member 110 and the roller 120 by rotations of the roller 120 in a direction of separating it from the surface of the transfer material carrying member 110. Therefore, as shown in FIG. 12(*b*), the attraction stability of the transfer sheet P with respect to the transfer material carrying member 110 is lowered.

The transfer material carrying member having the spacing between the dielectric layer and the foaming layer like the image forming apparatus of U.S. Pat. No. 5,390,012 would not offer a complete solution to the described problems.

SUMMARY OF THE INVENTION

It is an object of the present invention to provide a transfer device which permits desirable attraction conditions of a transfer material onto the surface of a transfer material carrying member to be maintained by controlling contact start conditions between the transfer material carrying member and charge application means.

In order to achieve the above object, a transfer device for transferring a developer image formed on an image carrying member to a transfer material, is characterized by:

- a transfer material carrying member for carrying the transfer material on a peripheral surface thereof;
- charge application means capable of freely movable to contact with the transfer material carrying member via the transfer material and to apart from the transfer material carrying member;
- control means for controlling contact start conditions between the transfer material carrying member and the charge application means,
- wherein when the transfer material passes through a spacing between the transfer material carrying member and the charge application means, the control means controls the contact start conditions in such a manner that a force is not exerted from the charge application means to a leading end portion of the transfer material so as to separate the leading end portion from the surface of the transfer material carrying member.

According to the described arrangement, the contact start conditions are controlled in such a manner that a force is not exerted from the charge application means to the leading end portion of the transfer material in a direction of separating the leading end portion from the surface of the transfer material carrying member. As a result, desirable attraction state of the transfer material onto the peripheral surface of the transfer material carrying member can be maintained.

In the described arrangement, it is preferable that the control means controls the contact start conditions in such a manner that the charge application means starts contacting with the transfer material carrying member in a non-image forming area on the leading end side of the transfer material.

According to the described arrangement, since the charge application means starts contacting with the transfer material in the non-image forming area on the leading end side of the transfer material, the contact start position of the charge application means does not fall in the image forming area of the transfer material, thereby eliminating the problem of irregularities in the potential due to the contact and non-contact of the charge application means within the image forming area of the transfer material. Therefore, more desirable attraction state of the transfer material onto the peripheral surface of the transfer material holding member can be maintained.

Further, it is preferable that the transfer device having the described arrangement further includes means for applying a voltage to the transfer material carrying member; and a power supply for applying to the charge application means a voltage having an opposite polarity to a voltage to be applied to the transfer material carrying member.

According to the described arrangement, a voltage having an opposite polarity to an application voltage of the transfer material holding member is applied to the transfer material via the charge application means. Therefore, even when the application voltage to the transfer material carrying member is low, a sufficient potential difference between the transfer material carrying member and the transfer material which determines an attraction of the transfer material with respect to the transfer material carrying member can be ensured. This eliminates a need of providing a high voltage power supply for the transfer material carrying member, and a compact and safe power supply can be used.

It is also preferable that the transfer device of the described arrangement further includes a power supply for applying a voltage to the charge application means in such a manner that a potential of the transfer material which has contacted with the charge application means is equivalent to the surface potential of the image carrying member directly before forming thereon the developer image.

According to the described arrangement, the transfer material which is charged to the same potential as the surface potential of the image carrying member directly before having the developer image formed thereon by a contact with the charge application means faces the image carrying member. Therefore, a damage on the image carrying member by a contact with the transfer material can be reduced. As a result, a longer life cycle of the image carrying member can be achieved, which contributes to reduce the running cost of the image forming apparatus, thereby providing an effectual solution to the environmental problems.

For a fuller understanding of the nature and advantages of the invention, reference should be made to the ensuing detailed description taken in conjunction with the accompanying drawings.

DESCRIPTION OF THE PREFERRED EMBODIMENT

Figure 1:
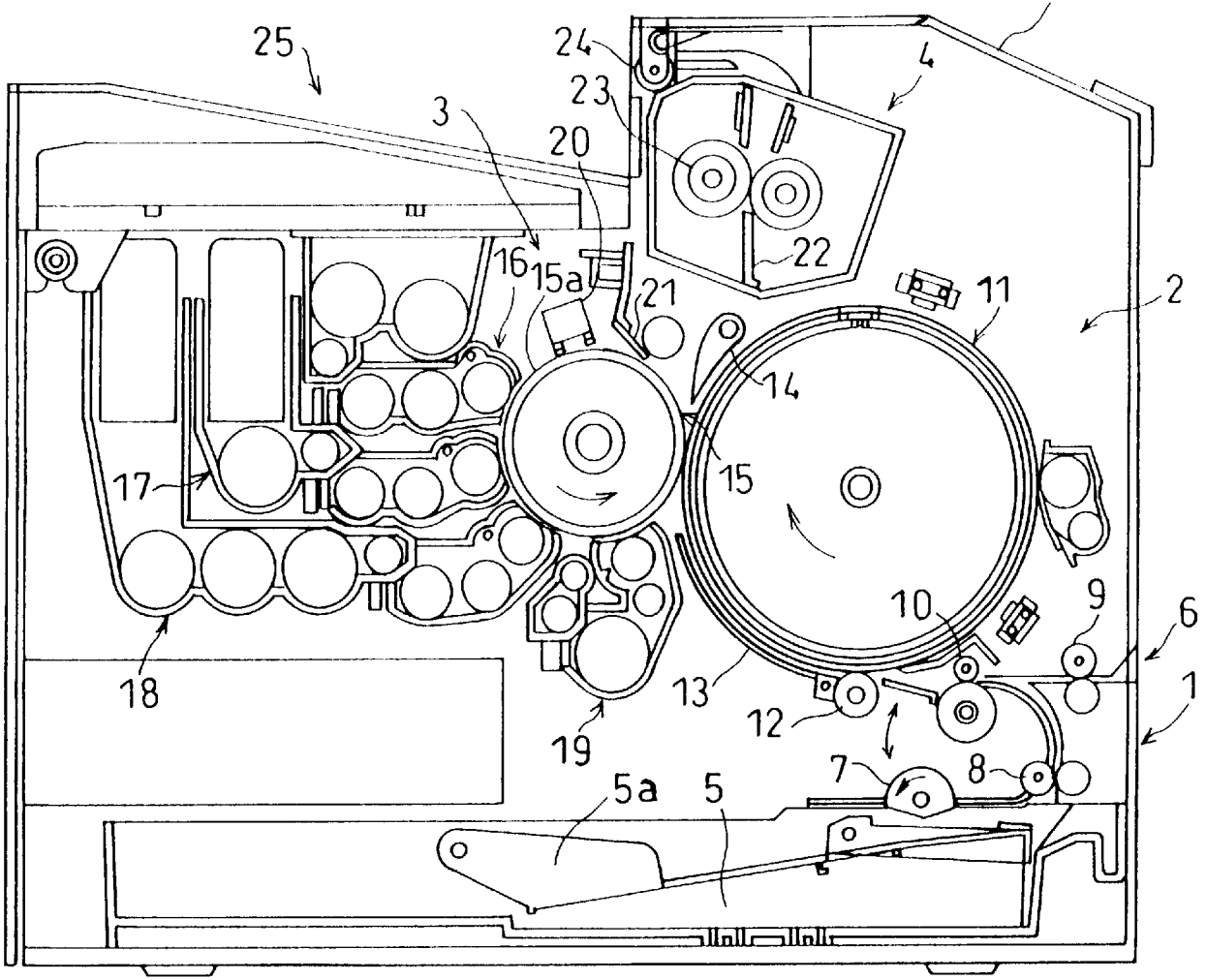
FIG. 1 is a view schematically showing a structure of an image forming apparatus provided with a transfer device in accordance with one embodiment of the present invention.

The following description explains one embodiment of the present invention while referring to the drawings.

As illustrated in FIG. 1, an image forming apparatus 31 in accordance with the present embodiment includes a feeding section 1, a transfer section 2, a development section 3, and a fixing section 4. The feeding section 1 feeds transfer sheets (transfer material) P sheet by sheet. The transfer section 2 is provided for transferring a developer image on the transfer sheet. The developer section 3 is provided for forming a developer image on the surface of a photoreceptor drum 15 (image carrying member). The fixing section 4 is provided for making the developer image transferred to the transfer sheet P to be permanently affixed thereon.

The feeding section 1 includes a feed cassette 5, a manual-feed section 6, a pickup roller 7, PF (paper feeding) rollers 8, manual-feed rollers 9, and pre-curl rollers 10. The feed cassette 5 is disposed on the lowest level of a main body of the image forming apparatus 31 so that it is can be installed in and removed from the main body as desired. The feed cassette 5 stores transfer sheet P and supplies it to the transfer section 2. The manual-feed section 6 is located on the front side of the main body and through which the transfer sheet P is supplied manually sheet by sheet from the front side. The pickup roller 7 feeds the transfer sheets P in order from the topmost sheet in the feed cassette 5 sheet by sheet. The PF rollers 8 transport the transfer sheet P fed by the pickup roller 7. The manual-feed rollers 9 transport the transfer sheet P fed from the manual-feed section 6. The pre-curl rollers 10 curl the transfer sheet P which has been transported by the PF rollers 8 or the manual-feed rollers 9.

The feed cassette S has a feeding member 5*a* pushed upward by, for example, a spring. The transfer sheet P is placed on the feeding member 5*a* in the feed cassette 5, and the topmost sheet of the transfer sheet P comes into contact with the pickup roller 7. By the rotations of the pickup roller 7 in the direction of an arrow, the transfer sheet P is fed sheet by sheet to the PF rollers 8. The transfer sheet P is then transported to the pre-curl rollers 10.

Meanwhile, the transfer sheet P supplied from the manual-feed section 6 is transported to the pre-curl rollers 10 by the manual-feed rollers 9.

As described above, the pre-curl rollers 10 curl the transported transfer sheet P so that it easily adheres to a surface of a cylindrical transfer drum 11 provided in the transfer section 2.

The transfer section 2 includes a transfer drum (transfer material carrying member) 11, which is freely rotatable. Disposed around the transfer drum 11 are pre-curl rollers 10, an electrode roller 12, a guide member 13, and a separating claw 14. The pre-curl rollers 10 are provided for curling the transfer sheet fed from feeding section 1 in a direction along a peripheral surface of the transfer drum 11. The electrode roller 12 functions as charge application means and is axially supported so as to be detachable from the peripheral surface of the transfer drum 11. The guide member 13 guides the transfer sheet P so that it is not separated from the transfer drum 11. The separating claw 14 separates the transfer sheet P from the transfer drum 11.

The development section 3 includes a photoreceptor drum (image carrying member) 15 which is brought into contact with the transfer drum 11 by pressure. The photoreceptor drum 15 is composed of a base 15*a* of a grounded conductive aluminum tube, and a photosensitive layer formed on a surface thereof.

Arranged radially around the photoreceptor drum 15 are developer containers 16, 17, 18 and 19, a charger 20, and a cleaning blade 21. The developer containers 16, 17, 18 and 19 contain yellow, magenta, cyan and black toners, respectively. The charger 20 charges the surface of the photoreceptor drum 15. The cleaning blade 21 scrapes and removes the toner remaining on the surface of the photoreceptor drum 15. Developer images in the respective colors are formed on the photoreceptor drum 15. More specifically, with the photoreceptor drum 15, a series of charging, exposing, developing and transfer processes are carried out for each toner color. Therefore, when transferring a color image, a developer image in one color is transferred to the transfer sheet P which is electrostatically attracted to the transfer drum 11 by one rotation of the transfer drum 11. Namely, a full color image is obtained by four rotations of the transfer drum 11.

The fixing section 4 includes fixing rollers 23 and fixing guide 22. The fixing rollers 23 affix the developer image to the transfer sheet P by fusing the developer image at a predetermined temperature and pressure. The transfer sheet P, which has been separated from the transfer drum 11 by the separating claw 14 after the transfer of the developer image, is guided to the fixing rollers 23 by the fixing guide 22.

A discharge roller 24 is disposed at a downstream section of the transfer-sheet transport path in the fixing section 4 so that the transfer sheet P with the developer image affixed thereon is discharged from the main body of the apparatus onto a discharge tray 25.

Figure 2:
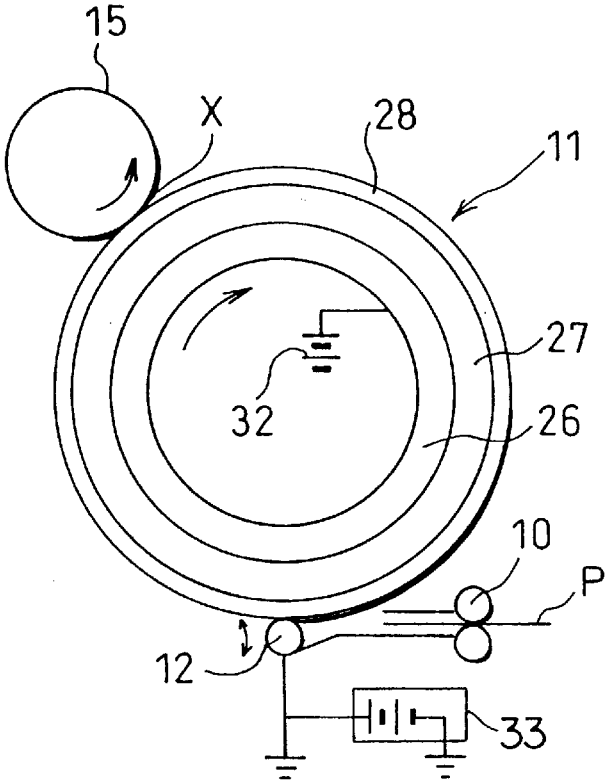
FIG. 2 is a view schematically showing a structure of the transfer device.

FIG. 2 is an explanatory view showing in details the transfer section 2 of the image forming apparatus 31.

First, the structure of the transfer drum 11 will be explained in detail.

As illustrated in FIG. 2, the transfer drum 11 includes a cylindrical base made of, for example, aluminum tube, which constitutes a conductive layer 26, an elastic semiconducting layer 27 on an upper surface of the conductive layer 26, and a dielectric layer 28 on an upper surface of the semiconducting layer 27. The conductive layer 26 is connected to a power supply 32 serving as a voltage application means, so that a voltage is stably maintained throughout the conductive layer 26.

To form the semiconducting layer 27, a resilient semiconducting foam material such as urethan rubber or elastomer may be used. By making the semiconducting layer 27 of a resilient semiconducting foam material, resiliency is rendered to the surface of the transfer drum 11, whereby a nip width between the transfer drum 11 and the photoreceptor drum 15 can be easily adjusted.

Figure 3:
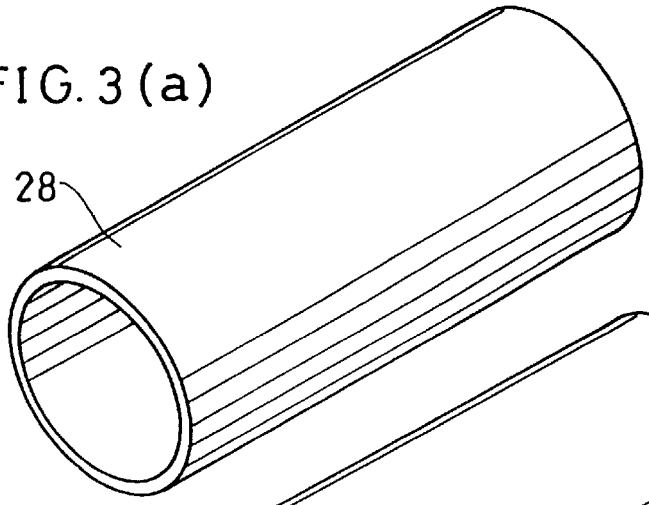
FIG. 3(*a*) and FIG. 3(*b*) are explanatory views showing one example method of manufacturing a transfer drum which constitutes the transfer device.
Figure 3:
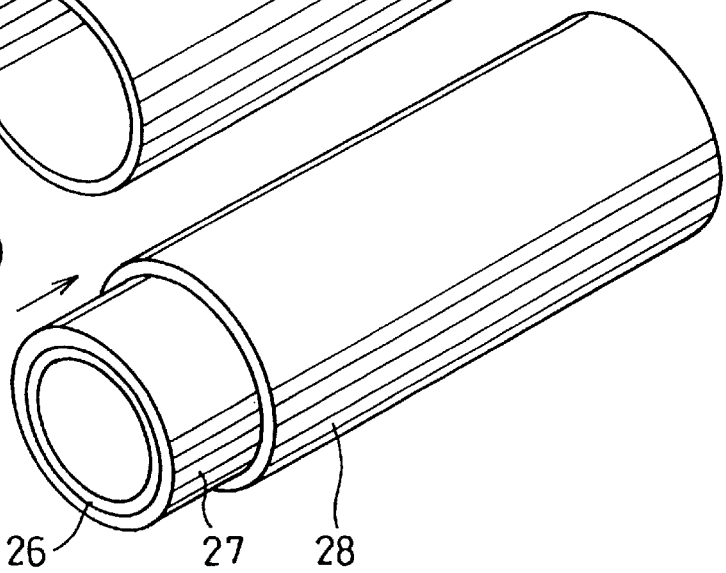

On the other hand, to form the dielectric layer 28, a polymer film made of a dielectric material such as PVDF (polyvinylidene fluoride) may be used. In the case of adopting PVDF formed in a cylindrical shape with no ends as the dielectric layer 28, as shown in FIG. 3(*a*), first, the dielectric layer 28 is expanded, for example, by feeding, air, etc., inside. Then, as shown in FIG. 3(*b*), the conductive layer 26 coated with the semiconducting layer 27 is placed inside the dielectric layer 28 as expanded, and the feeding of air, etc., is stopped, thereby fixing the dielectric layer 28 onto the peripheral surface of the semiconducting layer 27.

Figure 4:
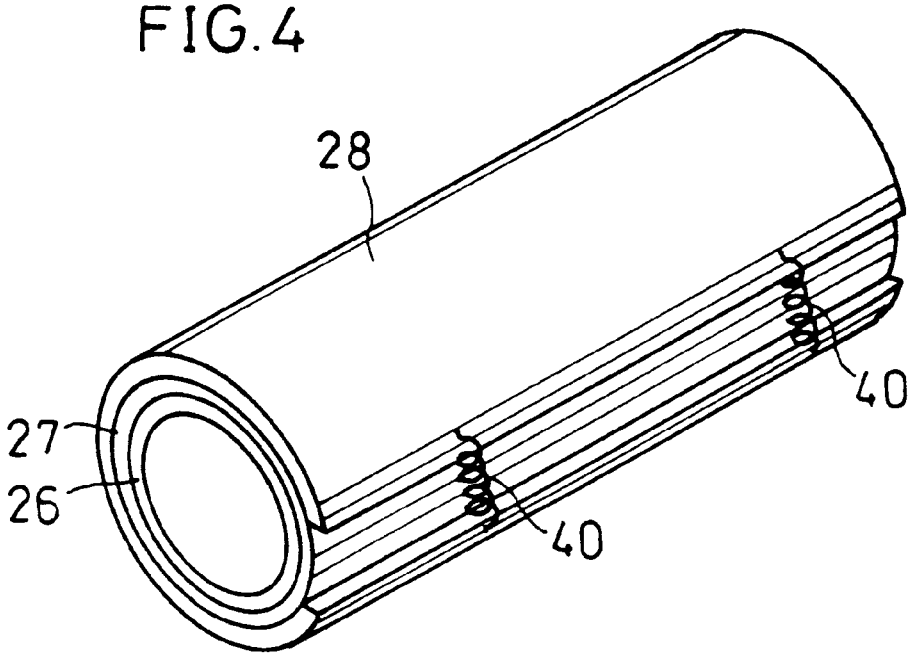
FIG. 4 is an explanatory view showing another structure of the transfer drum which constitutes the transfer device.

In the case of adopting the PVDF formed in a sheet as the dielectric layer 28, as illustrated in FIG. 4, after winding the dielectric layer 28 on the peripheral surface of the semiconducting layer 27 which covers the conductive layer 26, adjusting members 40 such as rubber or spring, etc., are mounted at both end portions of the dielectric layer 28. Then, the dielectric layer 28 is made adhere to the peripheral surface of the semiconducting layer 27 by the elastic force of the adjusting member 40 and is fixed.

The transfer drum 11 having the described arrangement is oriented such that its rotation axis is in parallel to the rotation axis of the photoreceptor drum 15. The peripheral surface of the transfer drum 11 is selected to be longer than the maximum length of the transfer sheet P in the transport direction which can be processed in the image forming apparatus 31. In a vicinity of the transfer drum 11 are placed the pre-curl rollers 10 and the electrode roller 12. The rollers 10 and 12 are axially supported in such a manner that their rotation axes are positioned parallel to the rotation axis of the transfer drum 11. The transfer sheet P fed from the feeding section 1 is curled by the pre-curl rollers 10 in a direction along the peripheral surface of the transfer drum 11. The transfer sheet P is then directed between transfer drum 11 and electrode roller 12 after being curled by pre-curl rollers 10.

As described, the electrode roller 12 of the present embodiment is grounded, and can be made to contact with or depart from the transfer drum 11 as explained below. Specifically, in the state where the transfer sheet P has not been fed, the electrode roller 12 is positioned to depart from the peripheral surface of the transfer drum 11. Then, after the leading end portion of the transfer sheet P has passed the spacing between the transfer drum 11 and the electrode roller 12, the electrode roller 12 is moved to contact the peripheral surface of the transfer drum 11 via the transfer sheet P. Further, after the rear end of the transfer sheet P has passed the spacing between the transfer drum 11 and the electrode roller 12, the transfer roller 12 is moved again to depart from the peripheral surface of the transfer drum 11.

Figure 5:
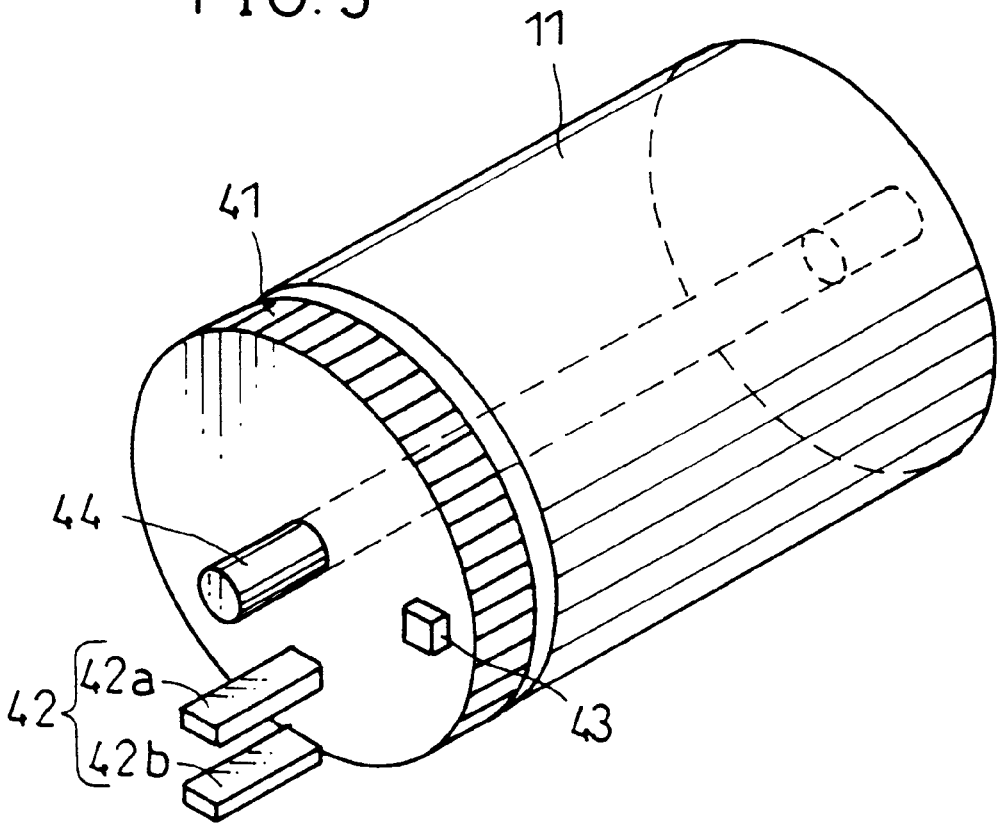
FIG. 5 is an explanatory view showing a structure of the transfer device on the side of a driving section.

As shown in FIG. 5, to the rotation shaft 44 projected from one side face of the transfer drum 11, a drive gear 41 (drive means) is affixed. Via this drive gear 41 and the clutch (not shown), the rotations of a main motor (not shown) provided in the image forming apparatus 31 is transmitted to the rotation shaft 44 of the transfer drum 11, thereby rotating the transfer drum 11. In a vicinity of the side face of the drive gear 41, a sensor 42 (detection means) is provided. This sensor 42 is constituted by a light. projection element 42*a* and a light receiving element 42*b* placed at a predetermined interval. To the side face of the drive gear 41, a projection 43 is formed. The projection 43 is arranged so as to pass between the light projection element 42*a* and the light receiving element 42*b* of the sensor 42 by the rotations of the drive gear 41, and to cut off the light from the light projection element 42*a*. According to the described arrangement, by detecting the light receiving signal from the light receiving element 42*b* which constitutes the sensor 42, the rotations of the drive gear 41 and the transfer drum 11 can be detected.

Figure 6:
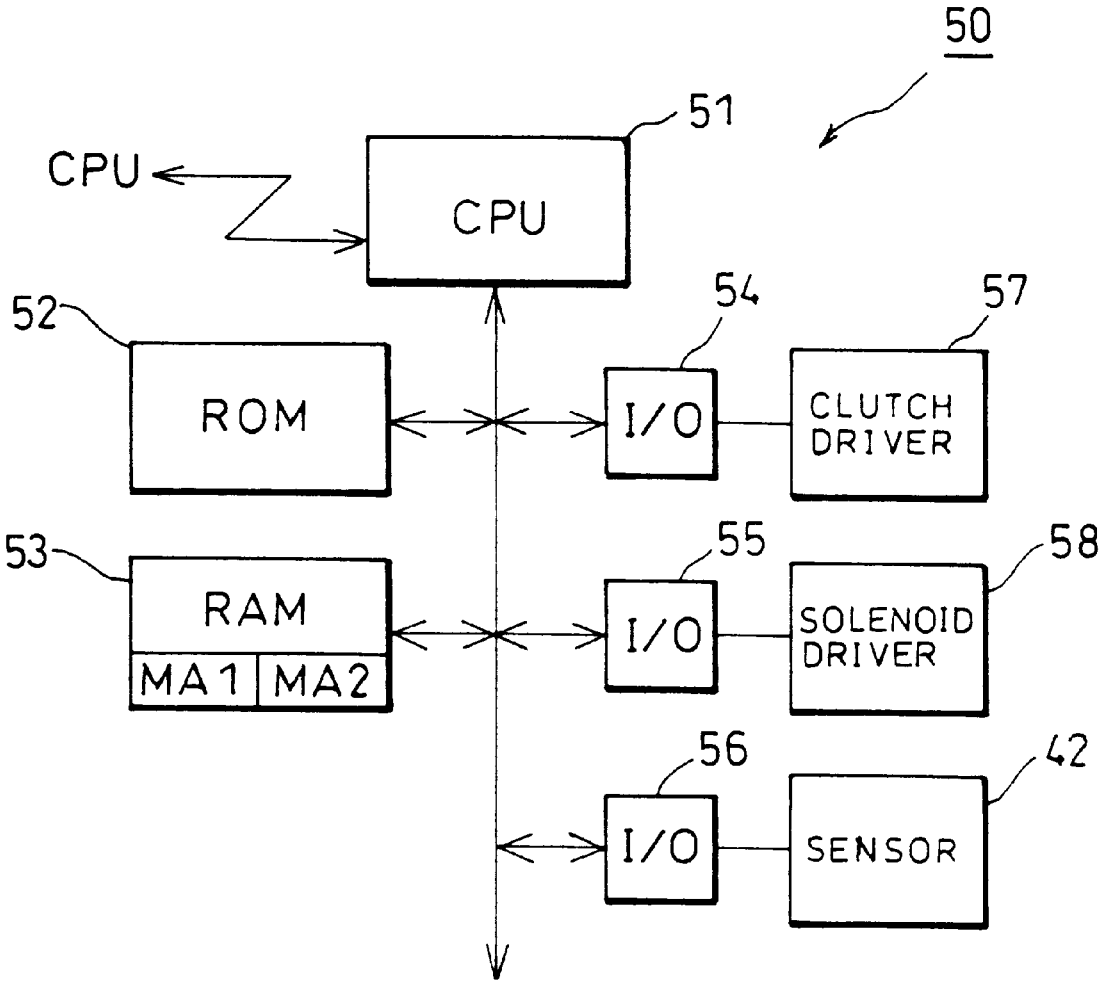
FIG. 6 is a block diagram showing a structure of the control side of the transfer device.

FIG. 6 is a block diagram showing the structure of the control section of the transfer device. As shown in FIG. 6, the control section 50 (control means) of the transfer device which constitutes the transfer section 2 of the image forming apparatus 31 of the present embodiment includes a CPU 51 provided with a ROM 52 and a RAM 53, interfaces 54 through 56, input output devices such as a clutch driver 57, a solenoid driver 58, a sensor 42, etc. The CPU 51 is connected to the input/output devices of the crutch driver 57, solenoid driver 58 and sensor 42, etc., via interfaces 54–56.

The CPU 51 controls the input/output devices according to a program written in ROM 52. The CPU 51 forms a master/slave structure with a master CPU (not shown) contained in a control section of the image forming apparatus 31. The CPU 51 inputs and outputs data to and from the master CPU.

The clutch driver 57 selectively transmits rotations of the main motor to drive gear 41 by operating a clutch disposed between the main motor and the drive gear 41 of the image forming apparatus 31. The solenoid driver 58 selectively moves the electrode roller 12 to the direction of contacting the transfer drum 11 by operating the solenoid provided in the electrode roller 12. The electrode roller 12 is acted on by an elastic force from a spring (not shown) to depart from the transfer drum 11.

Figure 7:
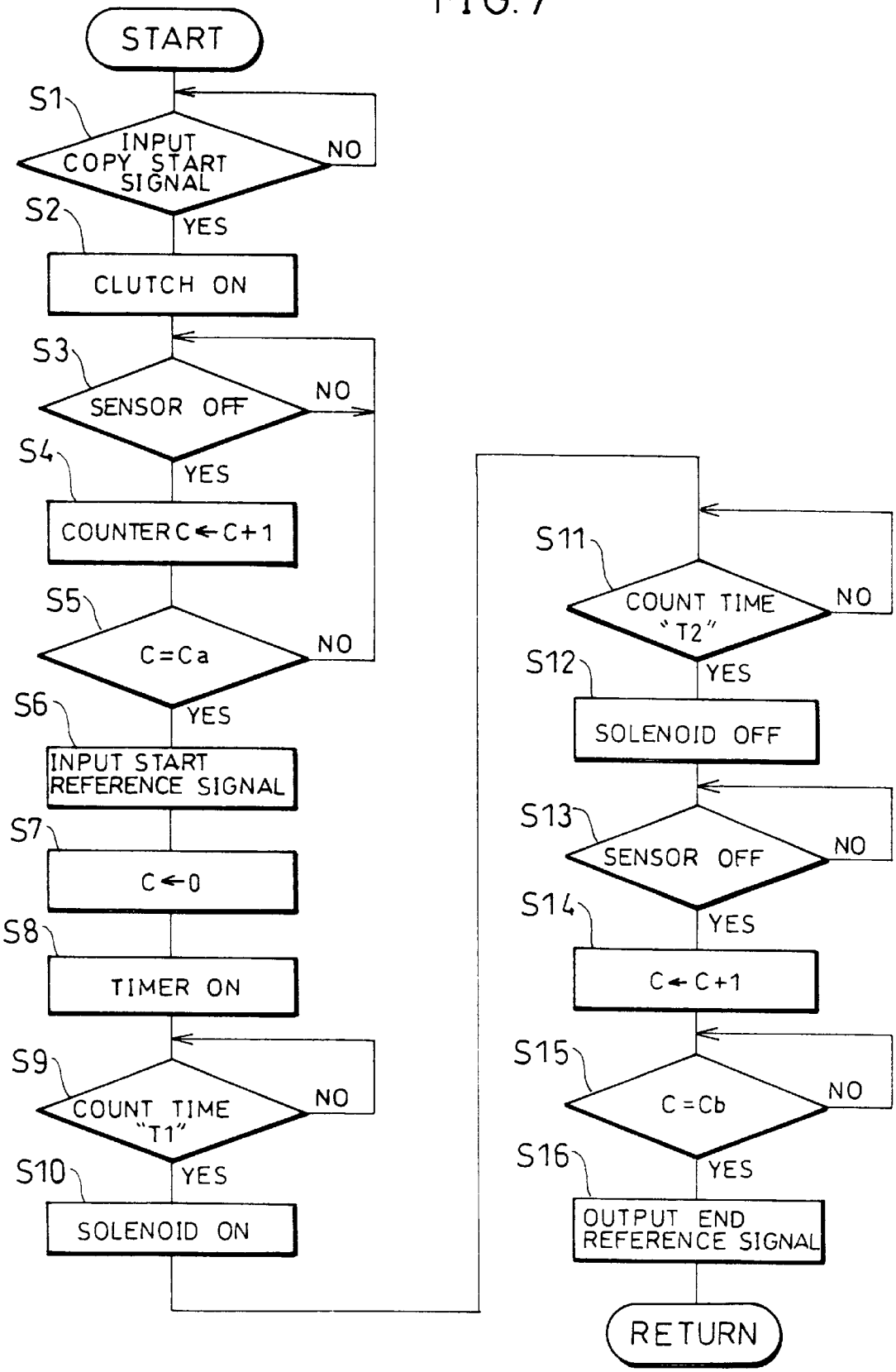
FIG. 7 is a flowchart showing an order of processing the control section of the transfer device.

FIG. 7 is a flowchart showing the processing order of the CPU which constitutes the control section of the transfer device. First, CPU 51 waits for an input of a start signal for starting an image forming operation from a master CPU (S1). Upon receiving the start signal, CPU 51 sets the clutch on with clutch driver 57 after a predetermined time has passed (S2). As a result, rotation of the main motor is transmitted to the drive gear 41 to start rotation of transfer drum 11.

Thereafter, CPU 51 waits for a light receiving signal of the sensor 42 to be set to OFF (S3). When the projection 43 passes through the spacing between the light projection element 42*a* and the light receiving element 42*b* by rotation of drive gear 41, the CPU 51 increments a calculated value of a counter C allocated to a memory area MA1 (S4). The CPU 51 repeats the processes in S3 and S4 until the calculation value of counter C reaches a predetermined value Ca set beforehand (S5). The predetermined value Ca has a minimum value of "1", and can be set in consideration of the time required for stabilizing the rotations of the main motor and the transfer drum 11.

Figure 8:
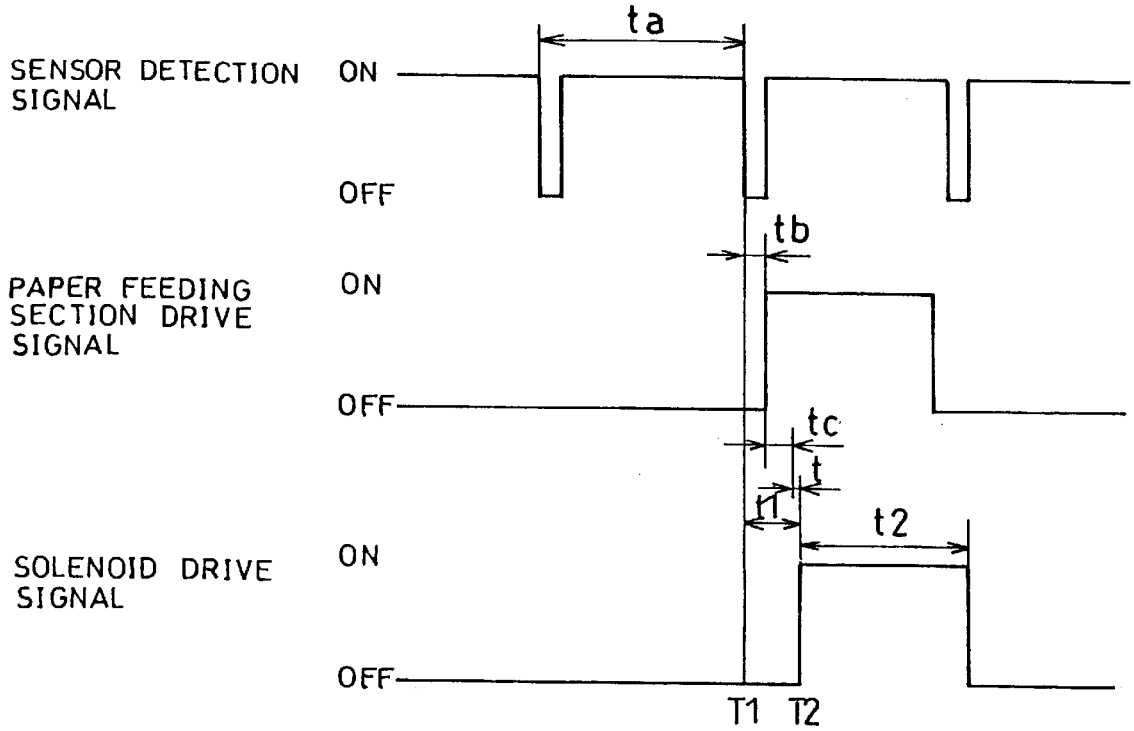
FIG. 8 is a timing chart of each signal in the transfer device and a part of the image forming apparatus.

When the calculated value of the counter C equals predetermined value Ca, CPU 51 outputs a start reference signal to the master CPU (S6). This start reference signal is used in the master CPU, for example, to determine the rotation start timing of the feed roller 7. Furthermore, the CPU 51 clears the calculated value of the counter C (S7), and starts a timer T allocated to a memory area MA2 of the RAM 53 (S8) and waits until the timer T counts a predetermined time "t1" set beforehand (S9). When the timer T finishes counting the predetermined time "t1" set beforehand (i.e., at the end of time period "t1", as depicted in FIG. 8), on via solenoid driver 58 (S10), and moves the electrode roller 12 towards the transfer drum 11.

The predetermined time "t1" is obtained by the following formula (1), $$t1=tb+tc+(X\times ta/L) \quad (1).$$

wherein "ta" is a time required for a rotation of the transfer drum 11, and "L" is a peripheral length of the transfer drum 11.

In the formula (1), "X" indicates a distance from the leading end of the transfer sheet P of the contact portion with the electrode roller 12 of the transfer sheet P when moving the electrode roller 12 towards the transfer drum 11, and the distance "X" is in arrange of around 5 to 15 mm as will be described later. The time "tb" indicates a time period from an output timing "T1" of the start reference signal to a start timing of a driving of the feed section. The time "tc" indicates a time period from the start of the feeding of the transfer sheet P to the time the leading end of the transfer sheet P as fed reaches the contact position between the transfer drum 11 and the electrode roller 12. Both the above-defined times "tb" and "tc" are set to predetermined fixed times in the image forming apparatus 31.

Namely, as shown in FIG. 8, when the time "tb" has passed from the output timing "T1" of the reference signal, the pickup rollers 7 of the feeding section 1 start driving. Further, when the time "tc" has passed, the leading end of the transfer sheet P reaches the contact position between the transfer drum 11 and the electrode roller 12. From this time, when the time t=(X×ta/L) has passed, (i.e., at the beginning of "T2") solenoid is set ON and the electrode roller 12 contacts the transfer drum 11 via the transfer sheet P.

In this state, the CPU 51 is set in a stand-by until the timer T, finishes counting the predetermined time "t2" set beforehand (S11). This predetermined time "t2" is selected so as to be shorter than the time required for the rear end of the transfer sheet P to pass the contact position between the transfer drum 11 and the electrode roller 12 from the timing "T1" of the start reference signal. When the timer T finishes counting the predetermined time "t2", CPU 51 stops the driving of the solenoid in electrode roller 12 by de-energizing solenoid driver 58 (S12).

Next, CPU 51 is set in a stand-by position until the detection signal of the sensor 42 is set to OFF a predetermined number of times (S13 through S15). Then, after the transfer drum 11 rotates a required number of times for forming an image (for example, four times) such that the calculated value of the counter C equals a predetermined value Cb, an end reference signal is output to the master CPU (616).

Figure 9:
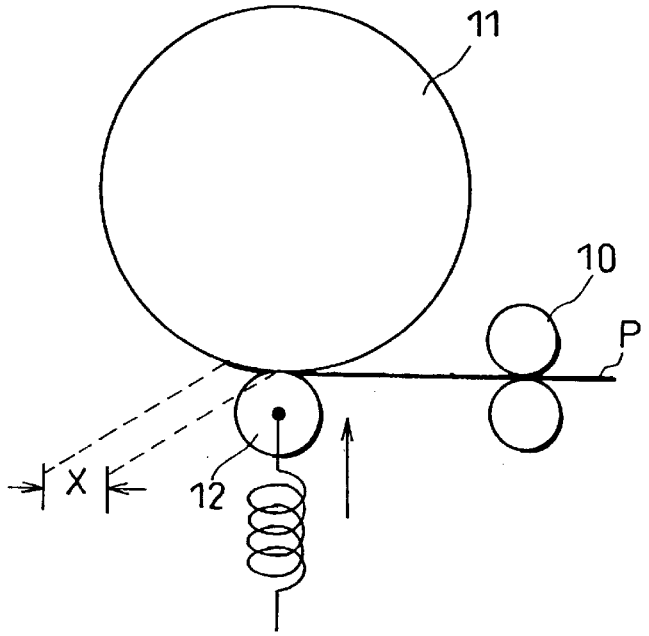
FIG. 9 is an explanatory view showing a contact start position of the electrode roller of the transfer device and the attraction state of the transfer sheet with respect to the transfer drum.
Figure 10:
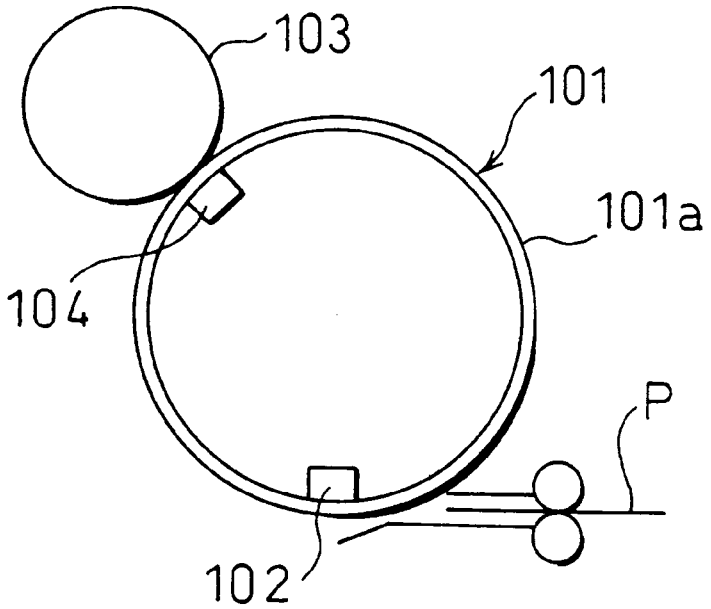
FIG. 10 PRIOR ART
FIG. 10 is a view schematically showing the structure of a conventional transfer device.
Figure 11:
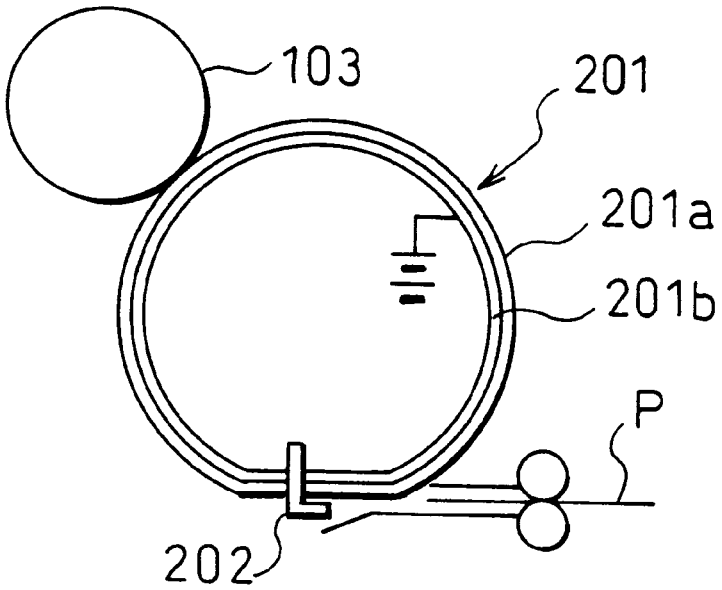
FIG. 11 PRIOR ART
FIG. 11 is a view schematically showing the structure of another conventional transfer device.
Figure 12:
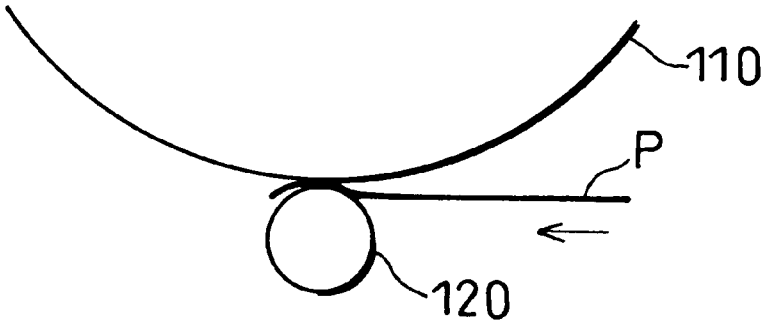
FIG. 12 (a) PRIOR ART
FIG. 12(*a*) and FIG. 12(*b*) are views showing an attraction state of a transfer sheet with respect to the transfer drum of the conventional transfer device.
Figure 12:
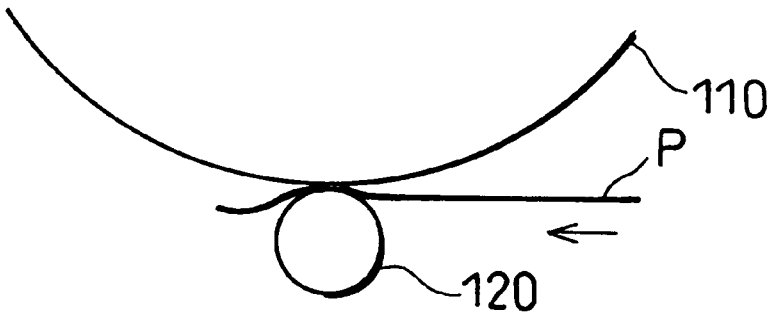
FIG. 12 (b) PRIOR ART

As shown in FIG. 9, when the leading end of the transfer sheet P passes the contact position between the transfer drum 11 and the electrode roller 12 by "X" mm, electrode roller 12 is moved towards Ai transfer drum 11. Then, the electrode roller 12 is kept in contact with the transfer drum 11 via the transfer sheet P until the rear end of the transfer sheet P passes the contact position between the transfer drum 11 and the electrode roller 12. According to the described arrangement, the electrode roller 12 does not contact the leading end portion of the transfer sheet P. Thus, no force is exerted on the leading end portion of the transfer sheet P which would separate it from the peripheral surface of the transfer drum 11. Therefore, the transfer sheet P can be attracted to the peripheral surface of the transfer drum 11 under desirable conditions.

Additionally, since the electrode roller 12 contacts the transfer sheet P just before facing the photoreceptor drum 15, the electrode roller 12 does not contact that portion of the transfer sheet P on which the developer image is transferred, thereby preventing detorioration of the developer image due to mechanical contact.

As a result, when the distance "X" required for determining the time "t1" is less than 5 mm, the attraction state of the transfer sheet P with respect to the peripheral surface of the transfer drum 11 cannot be improved. Additionally, when the electrode roller 12 contacts the transfer sheet P, a Paschen-discharge occurs suddenly as the electrode roller 12 contacts the transfer sheet P. This causes a non-uniform charge directly before and after the point at which the electrode roller 12 is brought in contact with the transfer sheet P. For this reason, in the case where the contact start position of the electrode roller 12 exits within the image forming range of the transfer sheet P, an image forming state becomes non-uniform. Therefore, it is desirable that the electrode roller 12 starts contacting the transfer sheet P at the non-image forming position. In consideration of the above, the distance "X" which determines the contact start position of the electrode roller 12 with transfer sheet P desirably falls in the range of 5 to 15 mm.

The following description will explain attraction of the transfer sheet P by transfer drum 11. Here, it is assumed that a positive voltage is applied by the power supply 32 to the conductive layer 26 of the transfer drum 11.

The electrostatic attraction of the transfer sheet P to the transfer drum 11 is caused by electric charge of the transfer sheet P having a polarity opposite to that of the voltage applied to the conductive layer 26 by a contact charge. Contact charge is carried out by Paschen discharge and charge injection.

The transfer sheet P thus transported to the transfer drum 11 is pressed by the electrode roller 12 against the surface of the dielectric layer 28, and on electric charge accumulated in the semiconducting layer 27 moves to the dielectric layer 28, thereby inducing a positive charge on the surface of the dielectric layer 28 which is in contact with semiconducting layer 27. Then, as the electrode roller 12 and the dielectric layer 28 of the transfer drum 11 get closer to each other, and when an electric field around the contact region (nip) where the dielectric layer 28 and the electrode roller 12 come into contact becomes stronger, aerial insulation breakdown occurs, thereby causing discharge, from the transfer drum 11 side to the electrode roller 12 side.

With this arrangement, negative charge is induced on a surface of the transfer drum 11 (i.e., the surface of the dielectric layer 28 coming into contact with the transfer sheet P), whereas positive charge is induced on an inner surface of the transfer sheet P (i.e., a surface portion of the transfer sheet P coming into contact with the dielectric layer 28).

Further, after the discharge, an electric charge is injected from the electrode roller 12 to the transfer drum 11 in the nip between the electrode roller 12 and the transfer drum 11, thereby further inducing the negative charge on an outer surface of the transfer sheet P (i.e., a surface of the transfer sheet P coming into contact with the electrode roller 12).

Thus, since the charge accumulated on the outer surface of the transfer sheet P has the polarity opposite to that of the voltage applied to the conductive layer 26, an electrostatic attraction is exerted between the transfer sheet P and the conductive layer 26, thereby causing the transfer sheet P to adhere to the transfer drum 11. In other words, it appears that as the potential of the transfer sheet P is higher, the electrostatic attraction causing the transfer sheet P to adhere to the transfer drum 11 is greater.

In the transfer device of the present embodiment, the electrode roller 12 is grounded. However, the present invention is not limited to this state. For example, the device may be arranged so as to apply to the electrode roller 12 a voltage of an opposite polarity to the voltage applied to the transfer drum 11.

The attraction of the transfer sheet P with respect to the transfer drum 11 is determined by a potential difference between the transfer drum 11 and the transfer sheet P. However, by applying to the electrode roller 12, the voltage of an opposite polarity to the voltage to be applied to the transfer drum 11, even in the case where an application voltage from the power supply section 32 of the transfer drum 11 is relatively low, a large potential difference between the transfer drum 11 and the transfer sheet P can be ensured, thereby eliminating a need of high voltage power supply for a power supply of the transfer drum 11. Therefore, a state and compact power supply device may be adopted for the power supply of the transfer drum 11.

Additionally a voltage may be applied to the electrode roller 12 in such a manner that the surface potential generated on transfer sheet P when contacting electrode roller 12 is equivalent to the surface potential of the photoreceptor drum 15 directly before the developer image is formed. As a result, damage on the photoreceptor drum 15 can be suppressed, to ensure a longer life cycle of the photoreceptor drum 15. Also, the running cost of the image forming apparatus can be reduced, thereby offering an effective solution to any environmental problems.

As described, a first transfer device which transfers a developer image formed on a surface of a photoreceptor drum to a transfer sheet is characterized by including:

a transfer drum for carrying the transfer sheet on a peripheral surface thereof, an electrode roller which can be moved to contact the transfer drum via the transfer sheet and which can be moved apart from the transfer drum, and a control section for controlling contact start conditions between the transfer drum and the electrode roller, wherein when the transfer sheet passes a spacing between the transfer drum and the electrode roller, the control section controls the contact start conditions in such a manner that a force is not exerted to a leading end portion of the transfer sheet from the electrode roller so as to separate the leading end portion from the transfer drum.

According to the arrangement described above since the contact start conditions are controlled in such a manner that a force is not exerted from the electrode roller to the leading end portion of the transfer sheet so as to separate the leading end portion from the surface of the transfer drum, the attraction state of the transfer sheet onto the surface of the transfer drum can be desirably maintained.

In the arrangement of the first transfer device, it is preferable that the control section controls the contact start conditions in such a manner that after the leading end of the transfer sheet passes the spacing between the transfer drum and the electrode roller, the electrode roller starts contacting the transfer drum on a non-image forming area of the leading end side of the transfer sheet.

According to the described arrangement, the electrode roller starts contacting with the transfer drum on a non-image forming portion of the leading end side of the transfer sheet. Thus, the contact start position on the transfer sheet does not fall in an image forming area, thereby eliminating irregularities in potential due to the contact of the electrode roller on an image forming area of the transfer sheet. Therefore, a more desirable attraction state of the transfer sheet in the surface of the transfer drum can be ensured.

Specifically, it is preferable that the control section controls contact start conditions in such a manner that the electrode roller starts contacting the transfer drum in a range of 5 to 15 mm from the leading end of the transfer sheet.

The first transfer device may be arranged so as to further include a power supply for applying a voltage to the transfer drum, and a power supply 33 (see FIG. 2) for applying tot he electrode roller, a voltage having a polarity opposite to the voltage applied to the transfer drum.

According to the described arrangement, a voltage having an opposite polarity to the application voltage of the transfer drum is applied to the transfer sheet via the electrode roller. Therefore, even when the application voltage to the transfer drum is low, a sufficient potential difference between the transfer drum and the transfer sheet, which determines the attraction of the transfer sheet with respect to the transfer drum, can be ensured. As a result, a high voltage power supply for the transfer drum is not needed, and a compact and safe power supply can be adopted.

Additionally, the first transfer device may be arranged so as to include a power supply 33 for applying a voltage to the electrode roller in such a manner that the potential of the transfer sheet which has contacted the electrode roller is charged to the same surface potential of the photoreceptor drum directly before forming thereon the developer image.

According to the described arrangement, the transfer sheet is charged to the same potential as that of the photoreceptor drum directly before the forming of developer image by contact of the transfer sheet with the electrode roller and the photoreceptor drum. Therefore, damage on the photoreceptor drum due to a contact with the transfer sheet can be suppressed. As a result, a longer life cycle of the photoreceptor drum can be achieved which contributes a reduction in running cost of the image forming apparatus, thereby providing an effectual solution to environmental problems.

The first transfer device may also be provided with a sensor for detecting a position of the transfer drum for carrying the transfer sheet.

The first transfer device may be arranged such that the transfer material carrying member includes a transfer drum which rotates while carrying thereon a transfer sheet and a drive gear for driving the transfer drum, wherein the sensor detects the rotation of the transfer drum by detecting the rotations of the drive gear.

The control section of the first transfer device may be arranged so as to include a timer for measuring the time from when the transfer sheet starts being supplied to the transfer drum. Based on this measured time, contact start conditions between the transfer drum and the transfer roller are controlled. The second transfer device may be arranged so as to further include a second control section for controlling the electrode roller so as to separate the electrode roller from the surface of the transfer drum after the rear end of the transfer sheet passes the spacing between the transfer drum and the electrode roller.

As described, the second transfer device of the present invention is provided with a transfer drum which rotates while carrying a transfer sheet around a peripheral surface thereof, the transfer sheet having a developer image transferred thereto from a surface of a photoreceptor, is characterized by including:

an electrode member capable of moving to contact a peripheral surface of a transfer drum via a transfer sheet and to depart from the peripheral surface of the transfer drum; and a control section for controlling a contact start timing of the electrode member so that the electrode member starts contacting with the surface of the transfer sheet on a non-image forming portion of the leading end side of the transfer sheet, after the leading end of the transfer sheet passes through a spacing between the transfer drum and the electrode member.

According to the described arrangement of the second transfer device, the electrode member starts contacting the peripheral surface of the transfer drum at a position behind where the leading end of the transfer sheet contacts the peripheral surface of the transfer drum. Therefore, the electrode member does not contact the leading end of the transfer sheet, thereby eliminating a force exerted onto the leading end of the transfer sheet so as to separate it from the peripheral surface of the transfer drum.

The third transfer device of the present invention, having the structure of the second transfer, is arranged so that the control means controls the contact start timing such that after the leading end of the transfer sheet passes through the spacing between the transfer drum and the electrode member, the electrode member starts contacting the transfer sheet at a portion in a range of 5 mm to 15 mm from the leading end thereof.

According to the arrangement of the third transfer device, the electrode member starts contacting the transfer sheet at the portion in the range of 5 to 15 mm from the leading end of the transfer sheet. In general, the portion outside the range up to 15 mm apart from the leading end, a developer image is not formed. Therefore, the electrode member starts contacting the transfer sheet on a non-image forming portion of the leading end side of the transfer sheet, and the contact start position and electrode member of the transfer sheet does not fall in the image forming area. As a result, irregularities in potential due to the contact of the electrode member on the image forming area of the transfer sheet can be eliminated.

The fourth transfer device, having the structure of the second or third transfer device of the present invention, is characterized by further including a power supply section for applying a voltage to the electrode member, wherein the voltage has a polarity opposite to that of an application voltage applied to the transfer drum.

According to the fourth arrangement, the voltage having an opposite polarity to that of the application voltage applied to the transfer drum is applied to the transfer sheet via the electrode member. Accordingly, even in the case where the application voltage to be applied to the transfer drum is low, a sufficient potential difference between the transfer drum and the transfer sheet can be ensured.

The fifth transfer device of the present invention, having the structure of the second or third transfer device, is characterized by further including a power supply section for applying a voltage to the electrode member so that the potential of the transfer sheet equals the surface potential of a photoreceptor directly before forming thereon the developer image.

According to the arrangement of the fifth transfer device, the transfer sheets is charged to the same potential as the surface potential of the photoreceptor directly before forming thereon developer image. Therefore, damage on the photoreceptor caused by a contact with the transfer sheet can be suppressed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transfer device for transferring a developer image formed on an image carrying member to a transfer material, comprising:

a transfer material carrying member for carrying said transfer material on a surface thereof;

a charge applicator capable of being moved into contact with, and apart from the transfer material carrying member via the transfer material;

control means for controlling contact start conditions between the transfer material carrying member and the charge applicator, wherein when the transfer material passes between said transfer material carrying member and said charge applicator, the control means controls the contact start conditions so that a force is not exerted from said charge applicator to a leading end portion of said transfer material to separate the leading end portion from the surface of said transfer material carrying member.

2. The transfer device as set forth in claim 1, wherein:

said control means controls the contact start conditions so that when the leading end portion of the transfer material has passed between the transfer material carrying member and the charge applicator, the charge application means contacts the transfer material carrying member on a non-image forming area of a leading end side of the transfer material.

3. The transfer device as set forth in claim 1, wherein:

the control means controls the contact start conditions so that the charge applicator contacts the transfer material carrying member at a position 5 to 15 mm from a leading end of the transfer material.

4. The transfer device as set forth in claim 3, further comprising:

voltage application means for applying a voltage to the transfer material carrying member; and a power supply for supplying to the change applicator, a voltage of an opposite polarity as compared to the voltage applied to the transfer material carrying member.

5. The transfer device as set forth in claim 3, further comprising:

a power supply for applying a voltage to the charge applicator so that a potential of the transfer material in contact with the charge applicator equals the surface potential of the image carrying member directly before the developer image is formed thereon.

6. The transfer device as set forth in claim 1, wherein:

the charge applicator is a grounded electrode roller.

7. The transfer device as set forth in claim 1, further comprising:

voltage application means for applying a voltage to the transfer material carrying member; and a power supply for supplying to the charge applicator, a voltage of an opposite polarity as compared to the voltage applied to the transfer material carrying member.

8. The transfer device as set forth in claim 1, further comprising:

a power supply for applying a voltage to the charge applicator so that a potential of the transfer material in contact with the charge applicator equals the surface potential of the image carrying member directly before the developer image is formed thereon.

9. The transfer device as set forth in claim 1, wherein:

the control means includes detection means for detecting a position of the transfer material carrying member for carrying the transfer material.

10. The transfer device as set forth in claim 9, wherein:

the transfer material carrying member includes a transfer drum which rotates while carrying the transfer material on a peripheral surface thereof, and a drive gear for driving the transfer drum, wherein the detection means detects rotation of the transfer drum by detecting rotation of the drive gear.

11. The transfer device as set forth in claim 1, wherein:

the control means includes a timer for measuring a time from when the transfer material starts being supplied to the transfer material carrying member, and controls the contact start conditions between the transfer material carrying member and the charge applicator based on a value measured by said timer.

12. The transfer device as set forth in claim 1, further comprising:

second control means for controlling the charge applicator to be moved apart from the surface of said transfer material carrying member after a rear end of the transfer material has passed between the transfer material carrying member and the charge applicator.

13. A transfer device for use in an image forming system, comprising:

a transfer material carrying member for carrying a transfer material on a surface thereon;

a charge applicator, freely moved in contact with, and apart from, the transfer material carrying member, wherein the transfer material is interposed between the transfer material carrying member and the charge applicator;

wherein a force exerted by the charge applicator on the transfer material does not cause the transfer material to separate from the surface of the transfer material carrying member.

14. A device according to claim 13, further comprising a control means for controlling conditions between the transfer material carrying member and charge applicator, wherein the control means stops a force from being exerted by the charge applicator, thereby preventing separation of a leading end portion of the transfer material from the surface of the transfer material carrying member.

15. A device according to claim 14, wherein the transfer material carrying member further includes a drum which rotates while carrying the transfer material thereon, and a drive gear for driving the drum, and wherein the control means further includes detection means for detecting rotation of the drum by detecting rotation of the drive gear.

16. A device according to claim 13, further comprising:

voltage application means for applying a voltage to the transfer material carrying member; and, a power supply for supplying a voltage to the charge applicator which has the opposite polarity of the voltage applied to the transfer material carrying member.

17. A device according to claim 13, further comprising:

an image carrying member for carrying an image to be formed on the transfer material; and, a power supply for supplying a voltage to the charge applicator so that a potential of the transfer material in contact with the charge applicator equals a surface potential of the image carrying member directly before an image is formed thereon.

18. A method for transferring an image from an image carrying member to a transfer material, comprising the steps of:

feeding a transfer material between a transfer material carrying member and a charge application device, wherein contact between transfer material carrying member and charge application device is externally controlled;

applying a charge to the transfer material carrying member with the charge application device, wherein the charge application device is capable of being freely moved in contact with, and apart from, the transfer material carrying member, and preventing a force exerted by the charge applicator on the transfer material to cause the transfer material to separate from the surface of the transfer material carrying member, thereby providing for efficient transfer of an image between the image carrying member and transfer material.

19. The method according to claim 18, further comprising the step of:

controlling conditions between the transfer material carrying member and charge application device with a controller, so that when the transfer material passes therebetween, a force exerted by the charge application device on the transfer material does not cause a leading end portion of the transfer material to separate from the surface of the transfer material carrying member.

20. A method according to claim 19, wherein the step of controlling further includes detecting a position of the transfer material carrying member.

* * * * *